United States Patent [19]

Hufford et al.

[11] 4,052,786

[45] Oct. 11, 1977

[54] METHOD OF MAKING A VARIABLE RESISTANCE CONTROL

[75] Inventors: James N. Hufford, Elkhart, Ind.; John Zdanys, Edwardsburg, Mich.

[73] Assignee: CTS Corporation, Elkhart, Ind.

[21] Appl. No.: 673,672

[22] Filed: Apr. 5, 1976

Related U.S. Application Data

[62] Division of Ser. No. 484,599, July 1, 1974, Pat. No. 3,950,722.

[51] Int. Cl.[2] ..... H01C 17/02; H01C 17/28

[52] U.S. Cl. ..... 29/610 R

[58] Field of Search ..... 29/610; 338/120, 150, 338/152, 162, 174

[56] References Cited

U.S. PATENT DOCUMENTS

| | | | |
|---|---|---|---|
| 2,894,237 | 7/1959 | Haynman | 338/150 |
| 3,032,734 | 5/1962 | Zunker et al. | 29/610 X |
| 3,543,398 | 12/1970 | Bender et al. | 29/610 |
| 3,561,113 | 2/1971 | Burke | 29/610 X |
| 3,576,510 | 4/1970 | Bruder | 338/150 |
| 3,639,878 | 2/1972 | Scheel | 338/174 |
| 3,657,688 | 4/1972 | Casey et al. | 338/150 |
| 3,729,817 | 5/1973 | Roven et al. | 29/610 R |
| 3,869,789 | 3/1975 | Yungblut et al. | 29/610 R |
| 3,947,800 | 3/1976 | Benthuysen et al. | 338/174 X |

*Primary Examiner*—Victor A. DiPalma
*Attorney, Agent, or Firm*—Jonn J. Gaydos

[57] ABSTRACT

A variable resistance control employing a support plate and a resistance element having a pair of spaced resistance paths applied on a base and rotatably mounted on the support plate. A pair of terminals with integral contacts are secured to the support plate and are disposed intermediate the base and the support plate. The pair of resistive paths are concentrically disposed on a surface of the base and electrically connected to each other. Each of the contacts engages a respective one of the resistive paths. In the assembly of the control, terminals are initially joined by a bridging member and, after the terminals are secured to the support plate, the bridging member is severed from the terminals providing a pair of separate terminals with integral contacts.

11 Claims, 7 Drawing Figures

METHOD OF MAKING A VARIABLE RESISTANCE CONTROL

This is a division of application Ser. No. 484,599, filed July 1, 1974, issuing as U.S. Pat. No. 3,950,722 on Apr. 13, 1976.

The present invention relates to electrical controls and, more particularly, to a variable resistance control and to a method for making same.

In many variable resistor control applications, in particular those applications requiring variable resistors of small size, it is often difficult to handle and assemble the component parts. A simple design with a minimum number of parts and assembly steps becomes of prime importance in producing an economical control. Prior art variable resistance controls such as disclosed in U.S. Pat. No. 3,657,688 generally comprise a base carrying a resistive path, a contactor engaging the resistive path, a conductive path carried by the base often overlying an end of the resistive path and contact means engaging the conductive path. Applying the resistive and conductive paths to the base requires two separate operations. Any extra operations, particularly when handling extremely small components can be very costly and time consuming. It would, therefore, be desirable to provide a variable resistance control having a pair of contacts engaging a pair of electrically connected resistive paths carried on a surface of a base.

To reduce the number of component parts in a variable resistance control, prior art devices such as disclosed in U.S. Pat. No. 3,581,265 provide a rotating contactor element engaging a resistive path and a conductive path carried by a base. However, in addition to the need to apply the conductive paths to the base in these controls, it is often necessary to provide separate terminals connected to the conductive paths to connect the control to an external circuit. Prior art devices such as disclosed in U.S. Pat. No. 2,894,237 and the above mentioned U.S. Pat. No. 3,657,688 provide integral terminal and contact means engaging a rotatable resistance element. However, although these controls eliminate the need for separate terminals, these controls are still relatively complex. It is necessary to align and secure the resistance element and the terminal and contact means to separate housing members and then to secure the housing members together. These additional operations are relatively uneconomical. It would therefore be desirable to provide a relatively inexpensive variable resistance control and method of making same wherein a single support plate secures both a rotatable resistance element and a pair of terminals with integral contacts in electrical engagement with the element.

Accordingly, it is an object of the present invention to provide a new and improved variable resistance control.

Another object of the present invention is to provide a method of making a variable resistance control comprising the steps of providing an electrically nonconductive frame of plastic material and carrying a shaft, aligning a pair of conductive members being provided with a pair of posts, securing the conductive members to the frame by deforming the posts, and rotatably securing a base having an aperture, a collector path, and a resistive path to the shaft by deforming the end of the shaft, the resistive path wipably engaging one of the conductive members, the collector path wipably engaging the other of the conductive members, and the shaft being received in the aperture of the base.

Another object of the present invention is to provide a method for providing a contactor for a variable resistance control comprising forming a unitary contactor, securing the unitary contactor to a frame, and severing the unitary contactor into two segments.

Further objects and advantages of the present invention will become apparent as the following description proceeds and the features of novelty characterizing the invention will be pointed out with particularity in the claims annexed to and forming a part of this specification.

Briefly, the present invention is concerned with a variable resistance control comprising a support plate with an integral shaft, a rotatable resistance element secured to the shaft and a pair of contact members with integral terminals disposed intermediate the support plate and the resistance element. The terminals are secured to the support plate. The resistance element comprises a base with a pair of electrically connected and spaced resistive paths on a surface thereof, each of the contact members engaging a respective resistive path. In the assembly of the control, the resistive paths are simultaneously applied on a surface of the base about an aperture and a conductive member comprising the contact members, integral terminals and a bridging member joining the terminals is secured to the support plate. The resistance element is then secured to the shaft with the contact members disposed intermediate the support plate and the resistance element. The bridging member is then severed providing two separate contact members.

For a better understanding of the present invention, reference may be had to the accompanying drawings, wherein the same reference numerals have been applied to like parts and wherein.

Figure 1:
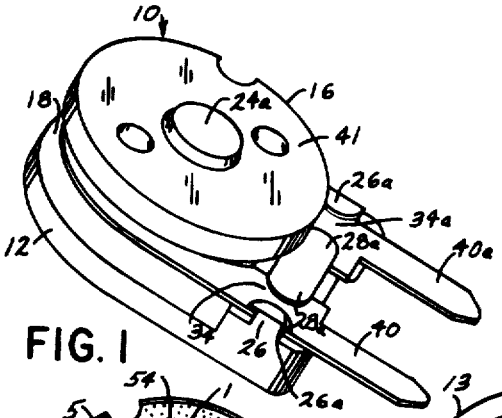
FIG. 1 is an isometric view of a variable resistance control built in accord with the present invention.

Referring now to the drawings, there is illustrated a variable resistance control generally indicated at 10 comprising a support plate 12, a conductive member 13 defining a pair of contact members 14 and **14*a* and a rotatable resistance element 16 secured to the support plate and electrically engaging the contact members 14 and 14*a***.

Figure 4:
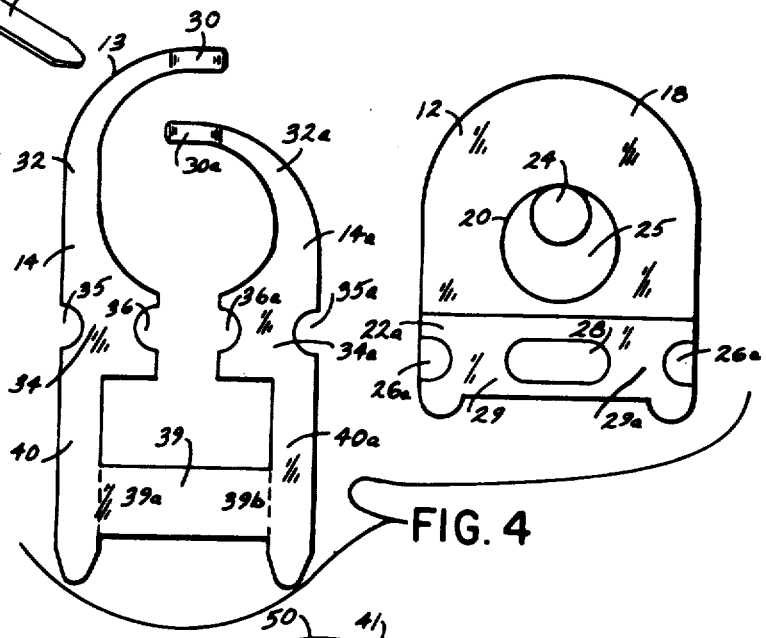
FIG. 4 is a top plan view of the support plate and the conductive member before attachment of the conductive member to the support plate.
Figure 5:
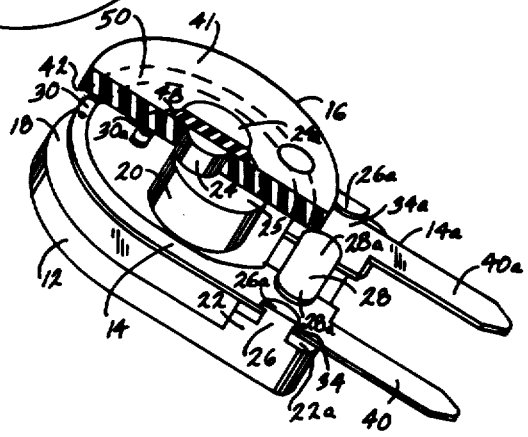
FIG. 5 is an isometric view of the control shown in FIG. 1 with a portion of the resistance element broken away.

Considering first the support plate 12, it preferably is of a one-piece molded construction of suitable electrically nonconductive material, such as plastic, with a first surface 18 supporting an integral hub 20 and an integral block 22 provided with a top surface **22*a*, the support plate 12 defining a generally semicircular configuration. Extending eccentrically from the hub 20 is a shaft 24 defining a shoulder 25** and extending integrally from the block 22 are a pair of end posts 26 and a center post 28, as best seen in FIGS. 4 and 5, the center post and end posts 26 and 28 defining a pair of channels 29 and 29a.

The contact members 14 and 14a are blanked and formed from spring tempered brass or other suitable material. Each of the contact elements 14 and 14a as best seen in FIG. 4, comprises a contact 30 and 30a and a spring arm 32 and 32a integral with each of the contacts 30 and 30a. Attachment segments 34 and 34a integral with the spring arms 32 and 32a are received in respective channels 29 and 29a and rest upon the top surface 22a of the block 22. Terminals 40 and 40a extend integrally from the attachment segments 34 and 34a for electrically connecting the variable resistance control 10 to an external circuit. A bridging member 39 as seen in FIG. 4 is attached to terminals 40 and 40a and provides means to handle and assemble the contact members 14 and 14a as an integral unit. In accord with the present invention, the attachment segments 34 and 34a are each provided with a pair of notches 35, 36 and 35a, 36a for aligning with and engaging end posts 26 and center post 28 upon assembly of the contact members 14 and 14a to the support plate 12. Each of the notches 35 and 35a engage a respective end post 26 and the notches 36 and 36a engage respective ends of the center post 28. The attachment segments 34 and 34a abut the block 22 with attachment segment 34 disposed in channel 29 and attachment segment 34a disposed in channel 29a. Portions 26a and 28a of the end posts 26 and center post 28 are heat swaged against the attachment segments 34 and 34a to rigidly secure the attachment segments 34 and 34a to the block 22. With the securement of the resistance element 16 to the support plate 12 to be hereinafter described, the resistance element 16 pushes the contacts 30 and 30a and spring arms 32 and 32a downwardly toward the surface 18 of the support plate 12 with the spring arms 32 and 32a biasing the contacts 30 and 30a into engagement with the resistance element 16. After attachment of the integral unit comprising the contact members 14 and 14a to attachment segments 34 and 34a and after attachment of the resistance element 16 to the support plate 12, the bridging member 39 is severed from the terminals 40 and 40a as indicated by lines 39a and 39b as seen in FIG. 4 leaving individual contact members 14 and 14a as best seen in FIG. 5.

Figure 2:
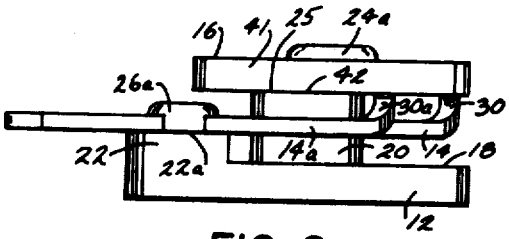
FIG. 2 is a side view of the control shown in FIG. 1.
Figure 3:
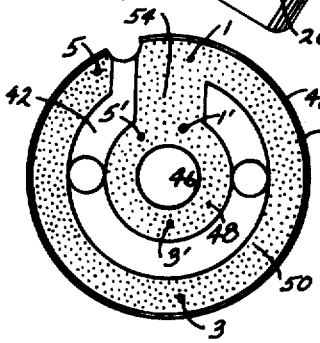
FIG. 3 is a bottom plan view of the resistance element of the variable resistance control shown in FIG. 1.

The resistance element 16 comprises a base 41 preferably of laminated plastic or other suitable dielectric material provided with a first surface 42 and a center aperture 46. In accord with the present invention, deposited in concentric relationship on the surface 42 are a closed circular resistive film or path 48 and an arcuate or open circular resistive path 50 as best seen in FIG. 3 with the resistive path 50 disposed around the periphery of the base 41 and the resistive path 48 disposed about the center aperture 46. A third resistive path 54 connects the resistive path 48 with one end of resistive path 50. The resistive paths 48, 50, and 54 preferably are of a carbon composition or any other suitable resistive material and are applied to the base 41 in any suitable manner well known in the art. To secure the resistance element 16 to the support plate, the shaft 24 is inserted through the center aperture 46 in the base 41 with the resistance element 16 abutting the shoulder 25. A portion 24a of the end of the shaft 24 is heat swaged against the back surface of the base 41 to secure the base 41 to the support plate 12. As best seen in FIG. 3, in accord with the present invention, the base 41 does not require a conductive path or return overlapping the ends of any of the resistive paths. The resistance element 16 provides an electrically nonconductive surface overlying the support plate 12, and, as seen in FIGS. 2 and 5 with the base 41 secured to the support plate 12, contact 30 engages resistive path 50 and contact 30a engages resistive path 48. It should be understood that the resistance element 16 in FIG. 5 is shown partially in transparent form and the dotted lines illustrate the resistive paths 50 and 48 on the underside of the base 41 in engagement with contacts 30 and 30a. As the resistance element 16 is rotated, resistive path 50 rotates with respect to contact 30 and resistive path 48 rotates with respect to contact 30a providing a greater or lesser amount of resistance between contacts 30 and 30a and thus between terminals 40 and 40a.

Figure 6:
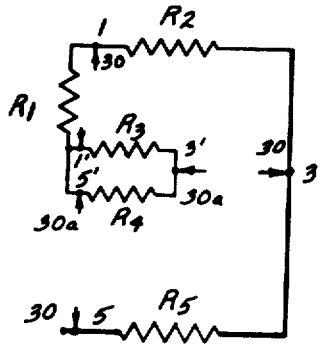
FIG. 6 is a schematic diagram illustrating the relationship of the contacts with respect to the resistive paths as the resistance element is rotated with respect to the contacts.

In operation with contact 30 at position 1 and contact 30a at position 1' as illustrated in FIGS. 3 and 6, there is a total resistance between contacts 30 and 30a approximately equal to the value of the resistive path 54 indicated as $R_1$ in FIG. 6. Rotating the resistance element approximately 180° with respect to contacts 30 and 30a places contact 30 at position 3 and contact 30a at position 3'. It can be seen in FIG. 3 that at position 3 and 3' the amount of resistance between contacts 30 and 30a is equal to the sum of resistance $R_1$ plus the equivalent resistance of the parallel branches of resistive path 48, indicated as $R_3$ and $R_4$ in FIG. 6, plus that portion of resistive path 50 between contact 30 and resistive path 54 indicated as $R_2$ in FIG. 6. When the resistance element 16 is rotated almost 360°, as illustrated in FIGS. 3 and 6 by contact 30 at position 5 and contact 30a at position 5', the total resistance between contacts 30 and 30a becomes approximately the total resistance of resistive paths 50 and 54 or $R_1 + R_2 + R_5$. At position 5', the contact 30a has rotated to the point where the resistance due to path 48 is almost negligible.

Figure 7:
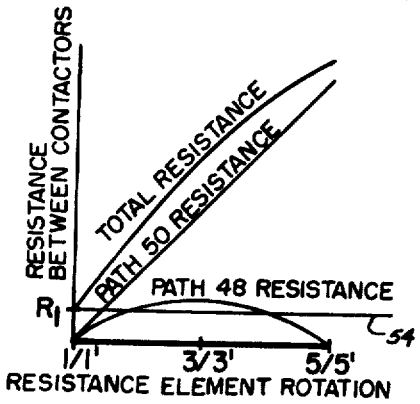
FIG. 7 is a graph of total resistance between contacts versus resistance element travel as the resistance element is rotated with respect to the contacts.

The relationship of the total resistance interposed between the contacts 30 and 30a as the resistive element is rotated with respect to contacts 30 and 30a is illustrated in FIG. 7. The ordinate represents the total amount of resistance interposed between the contacts 30 and 30a and the abscissa represents the position or rotation of the resistive paths 48 and 50 with respect to the contacts. The lower curve represents the changing parallel resistance of the contact 30a in engagement with the path 48 with respect to point 1', the middle line represents the linear resistance interposed by contact 30 engaging resistance path 50 with respect to point 1 and the line 54 represents the fixed resistance $R_1$ between points 1 and 1', and the upper curve represents the total of the three resistances. For example, at position 1/1' as illustrated in FIGS. 3 and 6, the interposed resistance is the value of the resistive path 54 or $R_1$. At position 3/3' or after a resistance element rotation of approximately 180°, the total resistance is approximately half the value of the resistance path 50 plus resistance $R_1$ plus the equivalent resistance value of the parallel paths of resistive path 48 from point 3' to point 1'. Position 5/5' illustrates the interposed resistance after rotation of approximately 360°. As seen in FIG. 7, the total resistance is resitance $R_1$ plus the total resistance of path 50.

From the above description, it is apparent that the variable resistance control can be rapidly assembled in production. For example, contact members 14 and 14a joined by bridging member 39 are aligned on the block 22 by engaging the center post 28 and end posts 26 with the notches 35, 35a, 36 and 36a. Portions of the posts are then heat swaged to secure the contact members to the block 22. Since no conductives are applied on the base 41 or the ends of the resistive paths, the resistance element 16 is prepared by one operation simultaneously applying the resistive films or paths 48, 50 and 54 on base 41. The shaft 24 is then inserted through the aperture in the resistance element 16 and a portion of the shaft is heat swaged against the back of the base 41 to secure the resistance element 16 to the support plate. The securement of the base 41 to the support plate 12 pushes the contacts 30 and 30*a* downwardly and the spring arms 32 and 32*a* bias the contacts 30 and 30*a* into engagement with the resistive paths 48 and 50.

While there has been illustrated and described what is at present considered to be a preferred embodiment of the present invention and a method of making the same it will be appreciated that numerous changes and modifications are likely to occur to those skilled in the art and it is intended in the appended claims to cover all those changes and modifications which fall within the true spirit and scope of the present invention.

We claim:

1. A method of making a variable resistance control comprising the steps of:

a. providing an electrically nonconductive frame of plastic material and carrying a shaft, b. aligning a pair of conductive members on the frame, one of the frame and the conductive members being provided with a pair of posts, c. securing the conductive members to the frame by deforming the posts, and d. rotatably securing a base having an aperture, a collector path, and a resistive path to the shaft by deforming the end of the shaft, the resistive path wipably engaging one of the conductive members, the collector path wipably engaging the other of the conductive members, and the shaft being received in the aperture of the base.

2. The method of claim 1, wherein the posts and the shaft are integral with the frame, the conductive members are connected together by a bridging member, and the step of aligning the pair of conductive members on the frame includes the step of separating the conductive members from each other by removing the bridging member.

3. The method of claim 1, wherein the frame includes a hub integral with the frame, the shaft is integral with the hub, and the step of securing the base to the shaft member includes the step of supporting the base on the hub.

4. The method of claim 3, wherein the frame is provided with a block integral with the frame, the posts extend outwardly from the block, and the step of aligning the pair of conductive members on the frame includes the step of supporting the conductive members on the block.

5. A method of making a variable resistance control comprising the steps of:

a. providing an electrically nonconductive frame of plastic material and carrying a shaft member, b. aligning a pair of conductive members on the frame, c. securing the conductive members to the frame, d. providing an apertured base comprising a pair of resistive paths on the shaft member, and e. securing the base on the shaft member.

6. The method of claim 5, wherein the frame includes post means and the step of securing the conductive members to the frame includes the step of deforming the post means against the conductive members.

7. The method of claim 6, wherein the step of securing the base to the shaft member includes the step of deforming the shaft member extending beyond the base.

8. A method of making a variable resistance control comprising the steps of:

a. providing a frame carrying a shaft member, b. aligning a pair of conductive members having insulation means to the frame, each of the conductive members being provided with a pair of contacts, c. securing the conductive members to the frame, d. providing an apertured base comprising a resistance path on the shaft member, and e. securing the base to the shaft member, the contacts wipably engaging the resistance path in spaced relationship.

9. A method of making a variable resistance control comprising the steps of:

a. providing a frame carrying a shaft member, b. aligning a unitary conductive member on the frame, c. securing the unitary conductive member to the frame, d. providing a base comprising a resistance path on the shaft member, e. securing the base to the shaft member, and f. forming a pair of conductive members from the unitary conductive member.

10. A method of making a variable resistance control comprising the steps of:

a. providing a frame carrying a shaft member, b. aligning a unitary conductive member on the frame, c. securing the unitary conductive member to the frame, d. forming a pair of conductive members from the unitary conductive member, e. providing a base comprising a resistance path on the shaft member, and f. securing the base on the shaft member.

11. A method for providing a contactor for a variable resistance control comprising:

a. forming a generally planar unitary contactor with a pair of integral segments from sheet material, b. bending portions of each of the segments of the contactor out of the plane of the contactor, c. securing the unitary contactor to a frame with the bent portions of each of the segments spaced outwardly from the frame, and d. severing the unitary contactor into two separate segments.

* * * * *